US008026654B2

(12) United States Patent
Kowalski et al.

(10) Patent No.: US 8,026,654 B2
(45) Date of Patent: Sep. 27, 2011

(54) IGNITION DEVICE HAVING AN INDUCTION WELDED AND LASER WELD REINFORCED FIRING TIP AND METHOD OF CONSTRUCTION

(75) Inventors: Kevin Jay Kowalski, Toledo, OH (US); Paul Tinwell, Fayence (FR)

(73) Assignee: Federal-Mogul World Wide, Inc., Southfield, MI (US)

( * ) Notice: Subject to any disclaimer, the term of this patent is extended or adjusted under 35 U.S.C. 154(b) by 577 days.

(21) Appl. No.: 11/861,834

(22) Filed: Sep. 26, 2007

(65) Prior Publication Data

US 2008/0174222 A1 Jul. 24, 2008

Related U.S. Application Data

(63) Continuation-in-part of application No. 11/624,272, filed on Jan. 18, 2007, now Pat. No. 7,923,909.

(51) Int. Cl.
*H01T 13/00* (2006.01)
*H01T 13/20* (2006.01)
*H01T 21/02* (2006.01)

(52) U.S. Cl. ..... 313/144; 313/141; 445/7

(58) Field of Classification Search ..... 313/118–145; 123/169 R, 169 EL, 32, 41, 310; 445/7
See application file for complete search history.

(56) References Cited

U.S. PATENT DOCUMENTS

| | | | | |
|---|---|---|---|---|
| 2,296,033 | A | | 9/1942 | Heller |
| 4,514,657 | A | | 4/1985 | Igashira et al. |
| 5,179,313 | A | | 1/1993 | Eves et al. |
| 5,347,193 | A | * | 9/1994 | Oshima et al. ..... 313/141 |
| 5,395,273 | A | | 3/1995 | Matsutani |
| 5,461,276 | A | | 10/1995 | Matsutani et al. |
| 5,558,575 | A | | 9/1996 | Chiu et al. |
| 5,793,151 | A | * | 8/1998 | Kagawa et al. ..... 313/141 |
| 5,811,915 | A | * | 9/1998 | Abe et al. ..... 313/141 |
| 5,977,695 | A | | 11/1999 | Osamura et al. |
| 5,998,913 | A | | 12/1999 | Matsutani |
| 6,078,129 | A | | 6/2000 | Gotou et al. |
| 6,093,071 | A | | 7/2000 | Osamura et al. |
| 6,132,277 | A | | 10/2000 | Tribble et al. |
| 6,304,022 | B1 | | 10/2001 | Matsutani |
| 6,533,628 | B1 | | 3/2003 | Matsutani |
| 6,595,818 | B2 | | 7/2003 | Uehara |

(Continued)

FOREIGN PATENT DOCUMENTS

JP 1289084 11/1989

(Continued)

*Primary Examiner* — Nimeshkumar Patel
*Assistant Examiner* — Jose M Diaz
(74) *Attorney, Agent, or Firm* — Robert L. Stearns; Dickinson Wright, PLLC

(57) ABSTRACT

An ignition device for an internal combustion engine and method of construction therefore includes a housing with an insulator secured therein. A center electrode is mounted within the insulator. A ground electrode extends from the housing with a portion of the ground electrode defining a spark gap across from the center electrode. The center electrode has a firing tip, wherein a resistance weld joint initially bonds the firing tip to the center electrode and a continuous bead of overlapping first weld pools formed substantially from the material of the firing tip further bonds the firing tip to the electrode. A continuous bead of overlapping second weld pools formed radially outwardly from the first weld pools forms a rounded shoulder surface extending from the first weld pools to an outer surface of the center electrode.

17 Claims, 5 Drawing Sheets

U.S. PATENT DOCUMENTS

| | | | | |
|---|---|---|---|---|
| 6,705,009 | B2 | 3/2004 | Niessner | |
| 6,724,132 | B2 | 4/2004 | Kanao | |
| 6,750,598 | B2 | 6/2004 | Hori | |
| 6,819,031 | B2 | 11/2004 | Hori | |
| 6,827,620 | B1 | 12/2004 | Mizutani | |
| 6,833,658 | B2 | 12/2004 | Niessner | |
| 6,846,214 | B1 | 1/2005 | Gotou et al. | |
| 6,923,699 | B2 * | 8/2005 | Matsubara et al. | 445/7 |
| 7,045,939 | B2 | 5/2006 | Teramura et al. | |
| 7,049,733 | B2 | 5/2006 | Lykowski et al. | |
| 7,084,558 | B2 | 8/2006 | Teramura et al. | |
| 7,109,646 | B2 | 9/2006 | Morita et al. | |
| 7,306,502 | B2 * | 12/2007 | Hori | 445/7 |
| 7,557,495 | B2 * | 7/2009 | Tinwell | 313/143 |
| 2002/0017846 | A1 * | 2/2002 | Hori | 313/141 |
| 2002/0105254 | A1 * | 8/2002 | Hori et al. | 313/141 |
| 2003/0038577 | A1 * | 2/2003 | Hori et al. | 313/141 |
| 2004/0100178 | A1 | 5/2004 | Kanao et al. | |
| 2004/0129683 | A1 | 7/2004 | Torii et al. | |
| 2004/0189169 | A1 * | 9/2004 | Taniguchi et al. | 313/141 |
| 2005/0168121 | A1 | 8/2005 | Tinwell | |
| 2006/0276097 | A1 | 12/2006 | Suzuki et al. | |

FOREIGN PATENT DOCUMENTS

| | | | |
|---|---|---|---|
| JP | 57-151183 | | 9/1992 |
| JP | 2005158322 | A * | 6/2005 |

* cited by examiner

IGNITION DEVICE HAVING AN INDUCTION WELDED AND LASER WELD REINFORCED FIRING TIP AND METHOD OF CONSTRUCTION

CROSS-REFERENCE TO COPENDING APPLICATION

This application is a continuation-in-part of U.S. patent application Ser. No. 11/624,272, filed on Jan. 18, 2007 now U.S. Pat. No. 7,923,909, which is incorporated herein by reference in its entirety.

BACKGROUND OF THE INVENTION

1. Technical Field

This invention relates generally to spark plugs and other ignition devices, and more particularly to electrodes having noble metal firing tips and to methods of construction thereof.

2. Related Art

Within the field of spark plugs, there exists a continuing need to improve the erosion resistance and reduce the breakdown voltage between the spark plug's center and ground electrodes. Various designs have been proposed using noble metal electrodes or, more commonly, noble metal firing tips applied to standard metal electrodes. Typically, the firing tip is formed as a pad or rivet which is then welded onto the end of the electrode.

In constructing firing tips with noble, also referred to as precious metals, there also exists a continuing need to improve the reliability of the attachment of the noble metal firing tip material to the electrode material, which is often constructed from a nickel alloy. For example, in U.S. Pat. No. 6,132,277, which is assigned to the assignee of the applicant herein, a precious metal is placed on a planar surface of the electrode, resistance welded, then resistance welded thereto. Further, the desired shape of the precious metal firing tip is preferably formed after resistance welding, and can then be resistance welded again to further secure the firing tip to the electrode which may have been loosened during the forming process or may not have been firmly attached during the initial resistance weld.

In U.S. Pat. No. 5,811,915, another construction of a spark plug having a precious metal chip secured to an electrode is disclosed. The '915 patent teaches attaching a noble metal chip formed of iridium, or an alloy thereof, by first resistance welding the chip to the electrode. During the resistance welding process, the noble metal chip remains unmelted, and is pushed toward the electrode so that it sinks into the melted electrode material, thereby forming protruding portions about an outer perimeter of the chip. Subsequently, a laser beam is applied to a point location, shown as being two points generally opposite one another, on the protruding portion of the electrode at an incident angle of 45 degrees to melt the impinged protruding portion of the electrode and a side surface of the noble metal chip in the vicinity of the protruding portion. Accordingly, a laser weld joint extends into a side surface of the precious metal chip above its lower surface which was previously sunk into the melted electrode material. Then, another peripheral laser weld is performed entirely along the outer periphery of the noble metal chip by rotating the electrode about its axis.

In U.S. Pat. No. 6,705,009, another construction of a spark plug having a precious metal secured to a center electrode is disclosed. The '009 patent teaches attaching a flat end of a continuous precious metal wire to a flat end of a tapered ignition tip of the center electrode via a first resistance or friction weld. During the first weld, the end of the wire forms a flat butt-weld joint with the end of the center electrode. The wire is then cut, and a second weld is formed via a laser about the outside periphery of the first weld joint between the cut wire and the center electrode.

In U.S. Pat. No. 6,819,031, another construction of a spark plug having a precious metal firing tip secured to an electrode is disclosed. The '031 patent teaches attaching a noble metal chip to a center electrode via a temporary resistance weld or a jig, and then forming a laser weld around a full circumference of the interface of the noble metal chip and the center electrode to form a first weld layer. Then, the laser is shifted along the longitudinal axis of the center electrode to form a second weld around the full circumference of the interface, with additional weld layers being possible thereafter, with each additional weld layer being shifted axially along the longitudinal axis of the electrode.

In U.S. Pat. No. 6,827,620, another construction of a spark plug having a precious metal secured to an electrode is disclosed. The '620 patent teaches attaching a noble metal chip to a center electrode via a provisional resistance weld, and thereafter forming a final laser weld. The noble metal chip is a pillar shaped element of iridium, or an iridium alloy material. During the provisional resistance welding, the chip is pressed with sufficient force to embed an unmelted portion of the pillar shaped chip into the electrode preferably not more than 0.1 mm.

Of all the known electrode constructions having a precious metal firing tip, including those discussed above, each comes with potential drawbacks. Some of the possible drawbacks include, increased costs in manufacture, a limited number of types of firing tip materials available for use, or a combination thereof. As such, the subject invention, among other things discussed and/or referenced herein, seeks to remedy these and any other potential problems present in the known constructions.

SUMMARY OF THE INVENTION

An ignition device for an internal combustion engine constructed in accordance with the invention includes a housing having an opening and an insulator secured within the housing. The insulator has an end exposed through the opening in the housing. A center electrode is mounted within the insulator and has an outer surface extending to an end beyond the insulator. A ground electrode extends from the housing with a portion of the ground electrode being located opposite the end of the center electrode to define a spark gap therebetween. The center electrode has a precious-metal firing tip initially bonded to its end by a resistance weld joint. A continuous bead of overlapping laser weld pools extends about an outer periphery of the firing tip to further bond the firing tip to the center electrode. The weld pools form at least a portion of a rounded shoulder that extends from the firing tip to the outer surface of the center electrode.

Another aspect of the invention includes an electrode assembly for an ignition device. The electrode assembly has an electrode body with an outer surface and a firing tip with a lower surface and an outer periphery. A resistance weld joint bonds the firing tip lower surface to the electrode body so that the lower surface is embedded a first distance beneath the outer surface. A continuous bead of overlapping laser weld pools is formed over the firing tip outer periphery, with the laser weld pools extending a second distance beneath the electrode body outer surface with the second distance being greater than the first distance.

Yet another aspect of the invention includes a method of constructing an ignition device for an internal combustion engine. The method includes providing a housing and securing an insulator within the housing so that an end of the insulator is exposed through an opening in the housing. Then, mounting a center electrode body having an outer surface within the insulator with a firing tip region of the center electrode body extending beyond the insulator. Then, extending a ground electrode body having an outer surface from the housing with a firing tip region of the ground electrode body being located opposite the firing tip region of the center electrode body to define a spark gap therebetween. Further, providing at least one preformed piece of firing tip material formed from noble metal. Further yet, resistance welding the at least one piece of firing tip material to at least one of the center electrode body or ground electrode body to at least partially form a firing tip, with the resistance weld joint defining a lower surface of the firing tip that is a first distance beneath the outer surface. Then, laser welding a continuous bead of overlapping laser weld pools over an outer periphery of the firing tip with the weld pools extending a second distance beneath the outer surface, wherein the second distance is greater than the first distance.

Another aspect of the invention includes a method of constructing an ignition device. The method includes providing an electrode body having an outer surface and a preformed piece of noble metal firing tip material. Then, resistance welding the firing tip material to the body to at least partially form a firing tip and defining a lower surface of the firing tip a first distance beneath the outer surface. Further, laser welding a continuous bead of overlapping laser weld pools over an outer periphery of the firing tip so that the weld pools extend a second distance beneath the outer surface, wherein the second distance is greater than the first distance.

BRIEF DESCRIPTION OF THE DRAWINGS

These and other features and advantages of the present invention will become more readily appreciated when considered in connection with the following detailed description of the presently preferred embodiments and best mode, and appended drawings, wherein like features have been given like reference numerals, and wherein.

DETAILED DESCRIPTION OF PRESENTLY PREFERRED EMBODIMENTS

Figure 1:
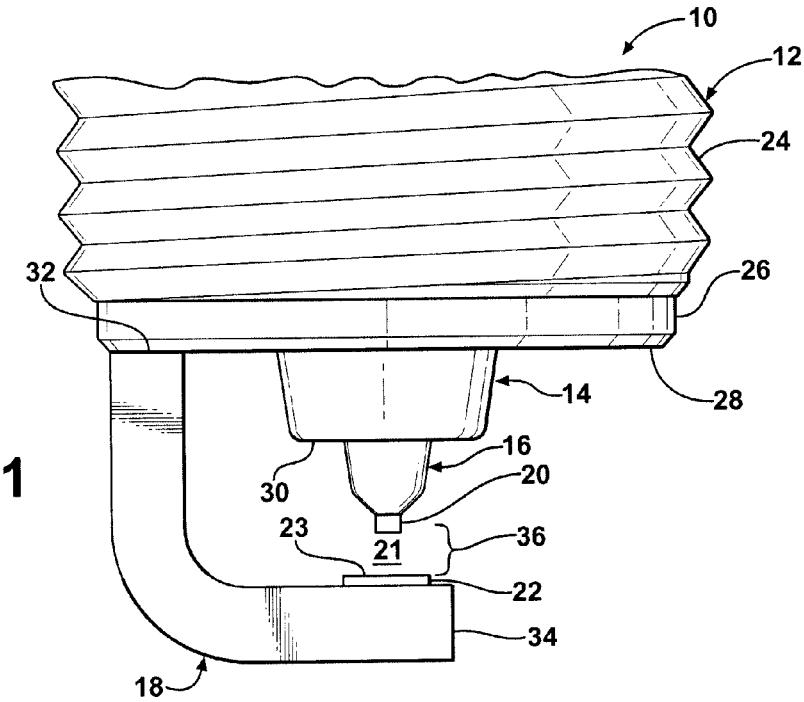
FIG. 1 is a partial side view of a spark plug having a center electrode and ground electrode constructed in accordance with one presently preferred embodiment of the invention.

Referring in more detail to the drawings, FIG. 1 shows a firing end of a spark plug 10 constructed according to one presently preferred method of construction of the invention. The sparkplug 10 includes a metal casing or housing 12, an insulator 14 secured within the housing 12, a center electrode 16, a ground electrode 18, and a pair of firing tips 20, 22 located opposite each other on the center and ground electrodes 16, 18, respectively. The housing 12 can be constructed in a conventional manner as a metallic shell and can include standard threads 24 and an annular lower end 26 from which the ground electrode 18 extends, such as by being welded or otherwise attached thereto. Similarly, all other components of the sparkplug 10 (including those not shown) can be constructed using known techniques and materials, with exception to the center and/or ground electrodes 16, 18 which have firing tips 20, 22 constructed in accordance with the present invention.

As is known, the annular end 26 of housing 12 defines an opening 28 through which the insulator 14 preferably extends. The center electrode 16 is generally mounted within insulator 14 by a glass seal or using any other suitable technique. The center electrode 16 may have any suitable cross-sectional shape, but commonly is generally cylindrical in cross-section having an arcuate flare or taper to an increased diameter on the end opposite firing tip 20 to facilitate seating and sealing the end within insulator 14. The center electrode 16 generally extends out of insulator 14 through an exposed axial end 30. The center electrode 16 is constructed from any suitable conductor, as is well-known in the field of sparkplug manufacture, such as various Ni and Ni-based alloys, for example, and may also include such materials clad over a Cu or Cu-based alloy core.

The ground electrode 18 is illustrated, by way of example and without limitations, in the form of a conventional arcuate ninety-degree elbow of generally rectangular cross-sectional shape. The ground electrode 18 is attached to the housing 12 at one end 32 for electrical and thermal communication therewith and preferably terminates at a free end 34 generally opposite the center electrode 16. A firing portion or end is defined adjacent the free end 34 of the ground electrode 18 that, along with the corresponding firing end of center electrode 16, defines a spark gap 36 therebetween. However, it will be readily understood by those skilled in the art that the ground electrode 18 may have a multitude of configurations, shapes and sizes.

The firing tips 20, 22 are each located at the firing ends of their respective electrodes 16, 18 so that they provide sparking surfaces 21, 23, respectively, for the emission and reception of electrons across the spark gap 36. As viewed from above firing tip surfaces 21, 23, such as that shown for the surface 23 in FIG. 7, which applies equally to the firing tip surface 21, it can be seen that the firing tip surfaces 21, 23 have a generally circular geometric shape, which is provided at least in part by the method of construction discussed hereafter. The firing tips 20, 22 of many presently preferred embodiments comprise noble metals that are relatively soft and have a lower melting point from that of a known and widely used firing tip noble metal, iridium (Ir), which has a melting temperature of about 2447 degrees Centigrade. The preferred noble metal used herein is platinum (Pt), which has melting temperature of about 1,769 degrees Centigrade, or an alloy thereof, such as platinum-nickel (Pt—Ni), for example, which has an even lower melting temperature. However, as discussed hereafter, some presently preferred embodiments can utilize Iridium, Iridium alloys, or other precious and even standard, non-precious metals.

In accordance with the invention, the firing tips 20, 22 are first resistance welded onto their respective electrodes 16, 18, and then they are at least partially laser welded to further secure their attachment to the electrodes and to prevent unwanted ingress of oxidation into the weld joint formed between the firing tips 20, 22 and the electrodes 16, 18. The resistance weld joint defines a lower surface 40 embedded a first distance (d) beneath an outer surface 42 of the respective electrode 16, 18. The laser weld joint defines overlapping weld pools 44 that extend a second distance (D) beneath the outer surface 42 of the respective electrode 16, 18, wherein the second distance (D) is greater than the first distance (d). To assist in establishing a reliable weld joint, and to further assist in inhibiting the ingress of oxidation, the laser weld joint is formed so that the respective firing tip 20, 22 is free from undercuts from the laser weld pools 44. Accordingly, each of the laser weld pools 44 forms a sidewall 46 that is firmly bonded to the respective firing tip 20, 22, wherein the sidewall 46 is either generally parallel to and/or extends radially outwardly from a central axis 48 of the firing tip 20, 22 as it extends below the outer surface 42.

Figure 2:
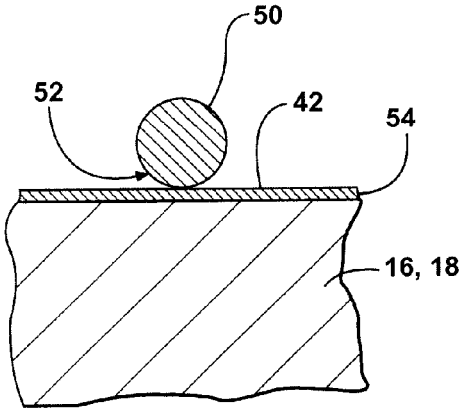
FIG. 2 is an enlarged partial side view of an initial step in the construction of the ground electrode according to one presently preferred embodiment of the invention.

In constructing the respective electrode 16, 18, as shown in FIG. 2, by way of example and without limitation, a preformed Pt pad 50, represented here as preferably having an arcuate, convex or spherical surface 52, and more preferably as being generally spherical or ball shaped, is placed on the outer surface 42 thereof. The pad 50 is then resistance welded to the electrode 16, 18. During the resistance welding process, with the outer surface 52 of the pad 50 being convex, any presence of oxide 54 formed on the outer surface 42 is caused to be evacuated during the resistance welding process, as indicated generally by arrows 56. Accordingly, as the generally spherical surface 52 of the pad 50 is pushed under force of a weld arbor (not shown) into the outer surface 42 of the electrode 16, 18, the oxide 54 is pushed outwardly from the weld joint. In addition, the generally convex shape presents a minimal contact area, theoretically established between the pad 50 and the electrode 16, 18 as a point, at least initially, which in turn increases the electrical resistance between the pad 50 and respective electrode 16, 18 during the resistance welding process, and thus, increases the heat generated during the resistance welding process. This facilitates the formation of a reliable resistance weld joint by providing a good bond between molten materials of the dissimilar materials being joined. Upon formation of a suitable weld pool of both materials, and upon pressing the pad 50 to the desired depth (d) below the outer surface 42 of the electrode 16, 18, the applied electrical current is turned off, and the established weld pool is permitted to solidify generally free from oxide inclusions.

Figure 3:
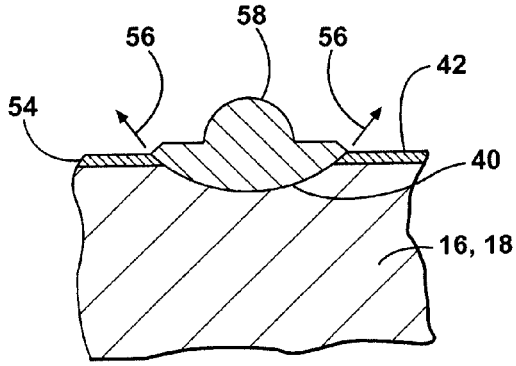
FIG. 3 is an enlarged partial cross-sectional side view of the ground electrode after performing a resistance welding process.
Figure 4:
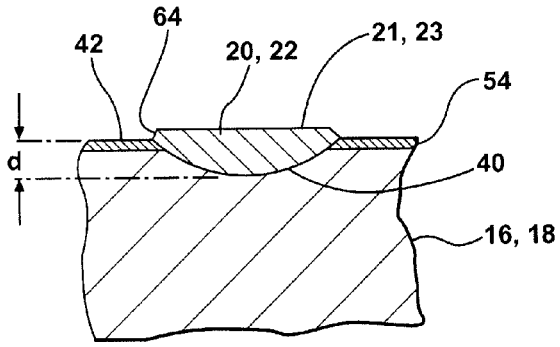
FIG. 4 is an enlarged partial cross-sectional side view of the ground electrode after performing a forming process.

Next, as shown in FIG. 3, a portion 58 of the pad 50 may require further shaping to attain the desired finish shape. As such, the pad 50 can be coined or otherwise shaped so that the firing surface 21, 23 of the respective firing tip 20, 22 is generally flat and parallel relative to the outer surface 42 of the electrode 16, 18, as shown in FIG. 4.

Upon forming the firing tip 20, 22, a laser weld joint 60 is established to increase the mechanical strength of the bond between the firing tip 20, 22 and the respective electrode 16, 18, such as, by way of example and without limitations, a GSI JK 450 450 Watt-Lumonics trepanning head with lamped pumped pulsed ND-YAG laser. It should be understood that the laser could be of any brand name, and that a continuous wave YAG, CO2, or other laser type could be used. In one preferred embodiment, the laser weld energy was controlled between about 1-1.5 J/pulse, the weld frequency between about 75-85 Hz, and the optical spot diameter between about 0.008-0.010 inches to provide individual weld pools of about 0.020 inches is diameter. To perform the laser weld, the laser head, and thus, a laser beam 62 was trepanned about the electrode 16, 18 and the respective firing tip 20, 22, which was held stationary. The preferred speed for trepanning the laser head is between about 140-160 rpm, while the preferred number of pulses/spot welds is between about 30-33. It should be recognized that depending on the particular application, that the aforementioned parameters could be altered, and further, that the work piece could be rotated and the laser beam maintained stationary, if desired. During the laser welding process, it is also preferred that a cover gas be used, such as argon, for example, wherein the flow rate of the cover gas can be controlled as best suited for the application, such as about 0.2 cfm, for example.

Figure 5:
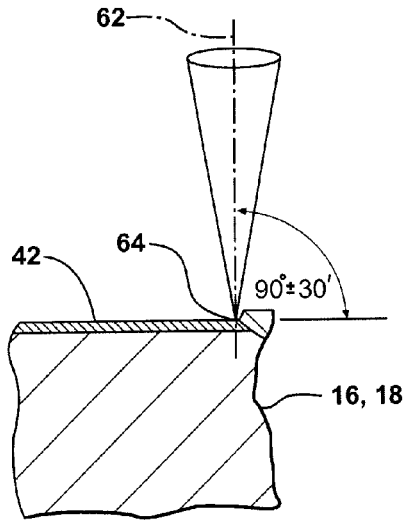
FIG. 5 is an enlarged partial side view of the ground electrode showing the orientation of a laser beam during a laser welding process.
Figure 7:
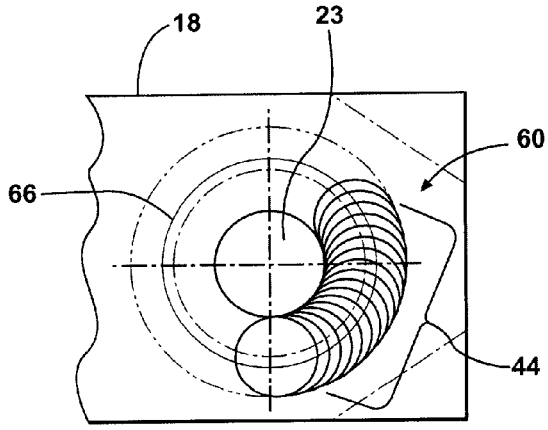
FIG. 7 is an enlarged partial top view of the ground electrode shown in a finished state.

As shown in FIG. 5, the laser beam 62 is preferably maintained between about an 80-90 degree orientation relative to the weld surface 42. In addition, the focal point of the laser beam is preferably maintained as close to an outer periphery 64 of the firing tip pad as possible, and preferably over an exposed weld joint seam 66 between the firing tip 20, 22 and the respective electrode body 16, 18 during the initial resisting welding process, thereby causing the continuous bead of overlapping weld pools 44 formed by the pulsed laser weld to completely cover the seam 66, as shown in FIG. 7. As noted above, this improves the strength of the bond between the firing tip material and the electrode material, while also inhibiting the ingress of oxygen into the weld joint established between the firing tip 20, 22 and the respective electrode 16, 18.

Figure 6:
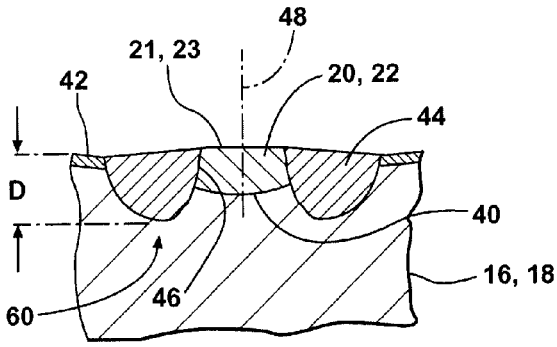
FIG. 6 is an enlarged partial cross-sectional side view of the ground electrode after performing the laser welding process.

As shown in FIG. 6, the individual laser weld pools 44 extend below the outer surface 42 of the electrode 16, 18 to the predetermined depth (D) that is greater than the depth (d) of the firing tip lower surface 40. Accordingly, the laser weld pools 44 extend below the resistance weld joint which was formed in the previous resistance welding process. With the orientation of the laser beam 62 being approximately 90 degrees to the outer surface 42 of the electrode 16, 18, the laser weld pools 44 are formed such that they do not form an undercut in the material defining the firing tip 20, 22. As shown in FIG. 6, the laser weld pools 44 form a toroid or annular ring having a generally frustroconical shape in axial cross-section, wherein the inner sidewalls 46 of the individual laser weld pools 44 bond to the respective firing tips 20, 22. The sidewall 46 of the solidified continuous laser weld pool is generally parallel to and/or extends radially outwardly from the central axis 48 of the firing tip 20, 22.

Figure 8:
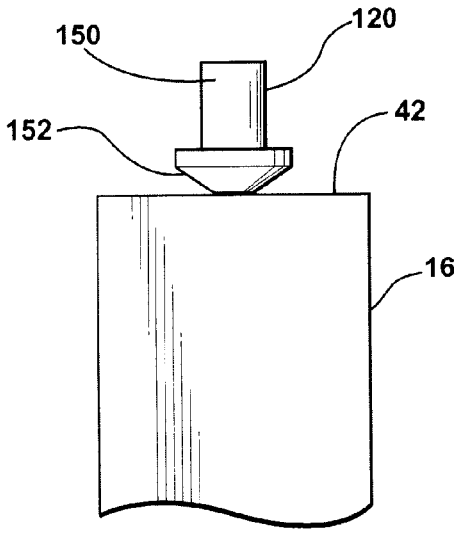
FIG. 8 is an enlarged partial side view of an initial step in the construction of the center electrode according to one presently preferred embodiment of the invention.
Figure 9:
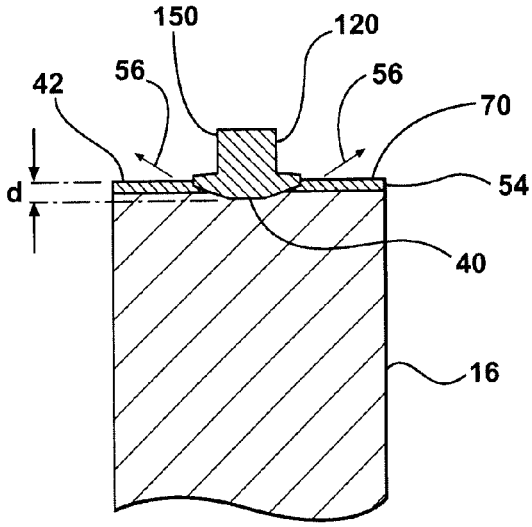
FIG. 9 is an enlarged partial cross-sectional side view of the center electrode after performing a resistance welding process.
Figure 10:
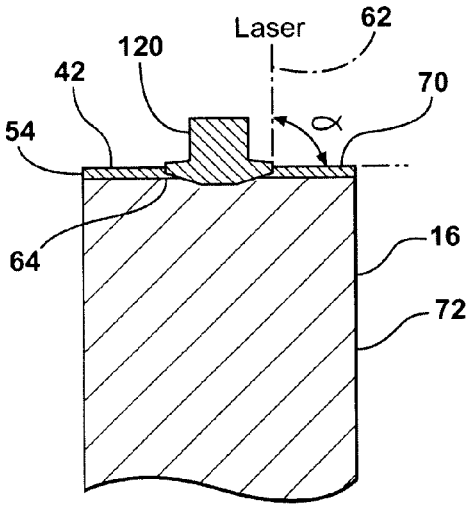
FIG. 10 is an enlarged partial cross-sectional side view of the center electrode showing the orientation of a laser beam during a laser welding process.
Figure 11:
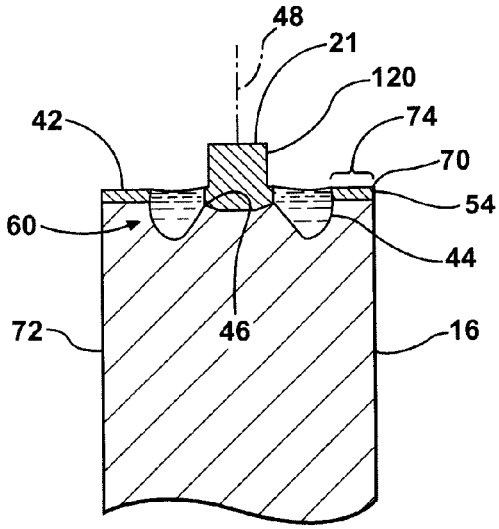
FIG. 11 is an enlarged partial cross-sectional side view of the center electrode after performing the laser welding process.
Figure 12:
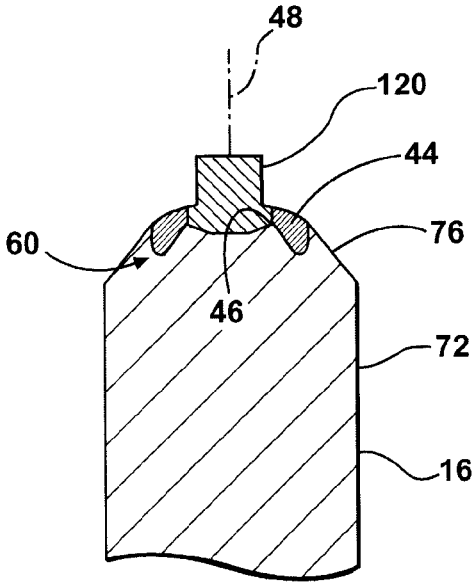
FIG. 12 is an enlarged cross-sectional side view of the center electrode in a finished state after performing a forming process.

As shown in FIG. 8, in another presently preferred construction, with particular reference being given to the center electrode 16, rather than utilizing an initially spherical Pt pad, a Pt or Pt-based rivet 150 having a generally frustroconical shaped end 152 for attachment to the center electrode is used to form a firing tip 120. As described above in association with the spherical or convex surface, the shape of the end 152 facilitates an increase in resistance and expulsion of oxide, as shown in FIG. 9 by arrows 56, during an initial resistance welding process. Accordingly, as in the previous embodiment, the Pt rivet 150 is first resistance welded to the end outer surface 42 of the center electrode 16. The Pt rivet 150 is preferably centered on the end, wherein an annular surface 70 of the end generally concentric to a longitudinal axis 48 of the electrode 16 remains exposed and generally free from the effects of the resistance weld process. Thereafter, as above, the Pt rivet 150 is further bonded to the center electrode 16 in a pulsed laser weld process. Given the center electrode 16 is typically cylindrical, the pulsed laser beam 62 can be trepanned as discussed above, or the center electrode 16 can be rotated, and the laser beam 62 maintained in a fixed location. The laser weld pools 44 are formed the same as described above, and are shown here as being formed spaced radially inwardly from a sidewall 72 of the center electrode 16. As such, as shown in FIG. 11, an annular ring 74 generally free from the effects of the laser weld process remains at the end of the center electrode 16. Upon completing the laser weld process, the center electrode 16 can be considered finished for use. Otherwise, as shown in FIG. 12, the end of the center electrode 16 can be formed, such as in a machining operation, to form a tapered conical wall 76 extending generally from the continuous laser weld pools 44 to the sidewall 72. Preferably, the tapered wall 76 is formed adjacent the laser weld pools 44, and is slightly spaced radially outwardly therefrom so as to not touch or extend into the laser weld pools 44.

Figure 13:
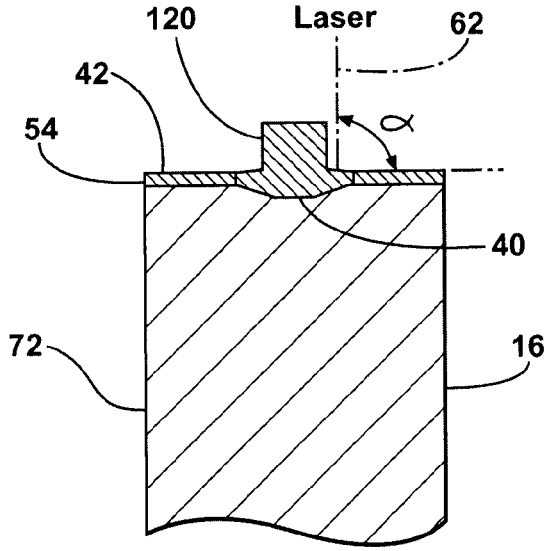
FIG. 13 is an enlarged partial side view of the center electrode showing the orientation of a laser beam during a laser welding process in accordance with another presently preferred embodiment of the invention.
Figure 14:
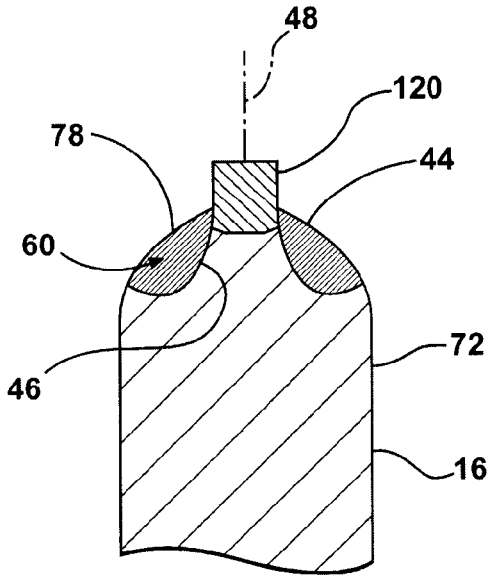
FIG. 14 is an enlarged cross-sectional side view of the center electrode shown in one presently preferred finished state upon completing the laser welding process.

In yet another presently preferred construction of the center electrode 16, as shown in FIGS. 13 and 14, rather than leaving an unaffected annular ring 74 between the sidewall 72 of the electrode 16 and the laser weld pools 44, the laser weld can be performed such that the laser weld pools 44 extend radially outwardly into contact with the sidewall 72, or substantially near thereto. This can be done by increasing the energy of the laser beam 62, by altering the optical spot diameter of the laser beam 62, by shifting the laser beam 62 laterally relative to the central axis of the electrode 16, or a combination thereof, thereby causing an increased area to be affected by the heat energy from the laser beam pulses. In so doing, the laser weld pools 44 preferably form a tapered or conical surface 78 without the necessity of performing a secondary machining operation, such as described in association with FIG. 12.

Figure 15:
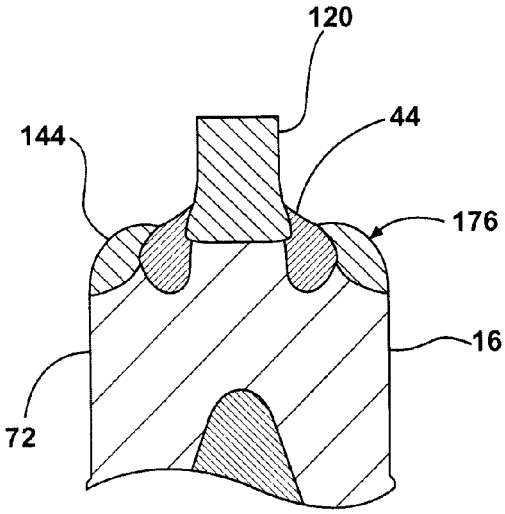
FIG. 15 is an enlarged cross-sectional side view of the center electrode shown in another presently preferred finished state upon completing the laser welding process.

In yet another presently preferred construction of the center electrode 16, as shown in FIG. 15, the laser welding process can be performed to establish two discrete zones of weld pools. A first weld zone of overlapping first weld pools 44 can be formed substantially from the material of the firing tip, represented here by way of example and without limitations as a rivet-style firing tip 120, while a radially outwardly second weld zone of second weld pools 144 encircling the first weld pools 44 can be formed substantially from the material of the center electrode 16. Although a rivet-style firing tip is represented here, it should be recognized that the firing tip could be constructed from any suitably shaped perform, such as those discussed above in relation to the firing tip 20, or otherwise. The laser weld power and speed can be predetermined as best suited for the materials be welded and maintained during relative movement of the center electrode 16 with the laser beam 62 to provide the desired surface rounding of an outer surface 176 extending from the first weld pools 44 radially outwardly to the outer surface of the sidewall 72 of the center electrode 16. Accordingly, the as laser welded surfaces 44, 144 can be provided as a finished rounded surface, represented here as being convex, or if desired, a subsequent supplemental process could be performed, such as surface grinding or polishing, for example.

Figure 16:
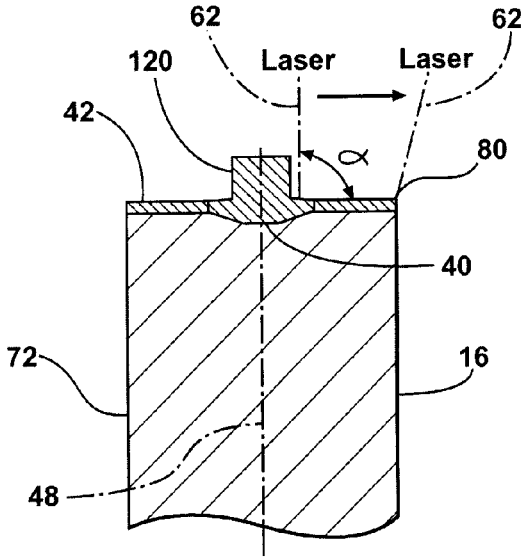
FIG. 16 is a view similar to FIG. 13 showing the orientation of a laser beam during a laser welding process used in constructing the center electrode of FIG. 15.
Figure 17:
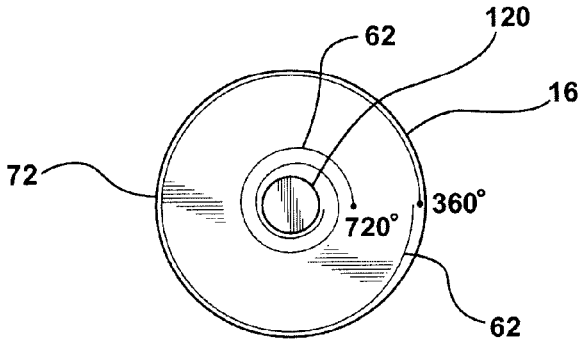
FIG. 17 is a plan view showing the general path of the laser taken during the laser welding process used in constructing the center electrode of FIG. 15.

As shown in FIGS. 16 and 17, the first weld zone forming the weld pools 44 is formed by rotating the center electrode 16 relative to the laser beam 62, such as by rotating the center electrode 16 on a rotating fixture of a dial table (not shown) about 720 degrees to form a pair of the overlapping first weld pools 44, for example. Then, the central axis 48 of the center electrode 16 is moved laterally relative to the laser beam 62 to focus the laser beam 62 on an outer peripheral edge 80 of the center electrode 16, such as by having the laser output housing fixed on a manual focus slide and a servo slide to enable the laser beam 62 to be moved relative to the center electrode 16. In one presently preferred embodiment, when the laser beam 62 is focused generally on the edge 80 of the center electrode 16, the laser beam 62 is oriented about 10 degrees from vertical, represented here by the central axis 48 of the center electrode 16, however, it should be recognized that the angle of inclination of the laser beam 62 from the central axis 48 could be oriented from about 5 to 60 degrees from the central axis 48, depending on the geometry of the resulting weld pools 144 desired. Upon focusing the laser beam 62 generally on the outer edge 80 at the desired inclination, the center electrode 16 is rotated on the dial table at least 360 degrees to form the second weld zone of overlapping second weld pools 144 radially outwardly from the first weld pools 44. The number of rotations of the center electrode 16 relative to the laser beam 62 can be varied, depending on the laser power, weld time, and materials used for the electrode 16 and firing tip 120. The firing tip 120 could be formed from a variety of materials, such as platinum, iridium, or other precious metals, and could be provided in a variety of preform shapes, including multilayered rivets or pads, for example. It should be further recognized that the novel laser rounding process described herein could be utilized on a standard, non-precious metal firing tip electrode. During the laser welding of the second weld zone forming the second weld pools 144, it should be recognized that material is not removed from the center electrode 16, as is the case with a machining process, nor is material added thereto.

Obviously, many modifications and variations of the present invention are possible in light of the above disclosure and accompanying figures. It is, therefore, to be understood that within the scope of the appended claims, the invention may be practiced otherwise than as specifically described.

What is claimed is:

1. An ignition device for an internal combustion engine, comprising:

a housing having an opening;

an insulator secured within the housing with an end of the insulator exposed through said opening in the housing;

a center electrode mounted within the insulator and having an outer surface extending to a free end beyond the insulator with a firing tip extending from said free end;

a ground electrode extending from the housing with a portion of the ground electrode being located opposite the firing tip of the center electrode to define a spark gap therebetween; and said center electrode having overlapping first laser weld pools bonding said firing tip to said free end of said center electrode and overlapping second laser weld pools radially outwardly from said first laser weld pools forming an annular exposed outer rounded surface extending from said first laser weld pools to said outer surface of said center electrode, wherein said first laser weld pools are formed substantially from melted material of the firing tip and said second laser weld pools are formed substantially from melted material of said center electrode.

2. The ignition device of claim 1 wherein said firing tip of said center electrode is a precious metal.

3. The ignition device of claim 2 wherein said firing tip is platinum-based.

4. The ignition device of claim 1 wherein said first laser weld pools and said second laser weld pools are discrete from one another.

5. The ignition device of claim 1 wherein said rounded surface is convex.

6. A center electrode for an ignition device, comprising:

an elongate electrode body having an outer surface extending to a free end;

a firing tip bonded to said free end; and a continuous bead of overlapping first laser weld pools bonding said firing tip to said free end of said center electrode and a continuous bead of overlapping second laser weld pools radially outwardly from said first laser weld pools forming an annular exposed outer rounded surface extending from said first laser weld pools to said outer surface of said center electrode, wherein said first laser weld pools are formed substantially from melted material of the firing tip and said second overlapping second laser weld pools are formed substantially from melted material of said center electrode.

7. The center electrode of claim 6 wherein said firing tip is a precious metal.

8. The center electrode of claim 6 wherein said firing tip is platinum-based.

9. The center electrode of claim 6 wherein said first laser weld pools and said second laser weld pools are discrete from one another.

10. The center electrode of claim 6 wherein said rounded surface is convex.

11. A method of construction for a center electrode, comprising:

providing an electrode body having an outer surface extending to a free end;

providing a firing tip material;

resistance welding said firing tip material to said free end;

laser welding a continuous bead of overlapping first laser weld pools substantially from material of the firing tip about said firing tip material; and after laser welding the continuous bead of overlapping first laser weld pools, laser welding a continuous bead of overlapping second laser weld pools substantially from material of said center electrode radially outwardly from said first laser weld pools forming an annular exposed outer rounded surface extending from said first laser weld pools to said outer surface of said electrode body.

12. The method of claim 11 further including providing said firing tip material as a precious metal.

13. The method of claim 12 further including providing said firing tip material as a platinum-based material.

14. The method of claim 11 further including forming said rounded surface having a convex outer surface.

15. A method of construction for a center electrode, comprising:

providing an electrode body having an outer surface extending to a free end;

providing a firing tip material;

resistance welding said firing tip material to said free end;

laser welding a continuous bead of overlapping first laser weld pools about said firing tip material;

laser welding a continuous bead of overlapping second weld pools radially outwardly from said first laser weld pools forming an annular rounded surface extending from said first laser weld pools to said outer surface of said electrode body; and further including forming said first weld pools with a laser beam moving circumferentially about said firing tip, moving said laser beam radially outwardly from said first laser weld pools, and forming said second weld pools with said laser beam moving circumferentially about said first laser weld pools.

16. The method of claim 15 further including forming said first laser weld pools by rotating said laser beam at least 720 degrees relative to said center electrode body.

17. The method of claim 15 further including inclining said laser beam between about 5 to 60 degrees from a central axis of said center electrode body to form said second laser weld pools.

* * * * *